US010774602B2

(12) United States Patent
Mlcak

(10) Patent No.: US 10,774,602 B2
(45) Date of Patent: Sep. 15, 2020

(54) HIGH RADIAL EXPANSION ANCHORING TOOL

(71) Applicant: Halliburton Energy Services, Inc., Houston, TX (US)

(72) Inventor: Matthew Craig Mlcak, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 216 days.

(21) Appl. No.: 15/035,469

(22) PCT Filed: Dec. 20, 2013

(86) PCT No.: PCT/US2013/076786
§ 371 (c)(1),
(2) Date: May 9, 2016

(87) PCT Pub. No.: WO2015/094317
PCT Pub. Date: Jun. 25, 2015

(65) Prior Publication Data

US 2016/0290081 A1 Oct. 6, 2016

(51) Int. Cl.
*E21B 23/01* (2006.01)

(52) U.S. Cl.
CPC ..... *E21B 23/01* (2013.01)

(58) Field of Classification Search
CPC ..... E21B 23/01
See application file for complete search history.

(56) References Cited

U.S. PATENT DOCUMENTS

| | | | | |
|---|---|---|---|---|
| 4,365,668 | A | 12/1982 | Bright | |
| 4,488,595 | A | 12/1984 | Akkerman | |
| 4,498,534 | A | 2/1985 | Lindsey, Jr. | |
| 4,690,214 | A | 9/1987 | Wittrisch | |
| 4,941,532 | A * | 7/1990 | Hurt | E21B 23/01 166/216 |
| 4,971,146 | A | 11/1990 | Terrell | |
| 5,025,861 | A | 6/1991 | Huber et al. | |
| 5,791,409 | A * | 8/1998 | Flanders | E21B 29/005 166/55.8 |
| 6,702,010 | B2 | 3/2004 | Yuratich et al. | |

(Continued)

FOREIGN PATENT DOCUMENTS

WO 1998001651 1/1998

OTHER PUBLICATIONS

International Search Report and Written Opinion of PCT Application No. PCT/US2013/076786 dated Sep. 25, 2014: pp. 1-18.

(Continued)

*Primary Examiner* — Waseem Moorad
*Assistant Examiner* — Neel Girish Patel
(74) *Attorney, Agent, or Firm* — Chamberlain Hrdlicka

(57) ABSTRACT

An anchoring tool is presented having radially pivoting arms which are moved from a run-in position to a set position. In the run-in position the un-articulated arms are positioned radially inward to provide a small tool outer diameter. Upon setting, the arms are pivoted radially outward into gripping engagement with a downhole tubular, such as a liner or casing. The pivot arms define a cam surface for interaction with corresponding wedges, where the cam surface allows for greater radial expansion of the arms.

27 Claims, 5 Drawing Sheets

(56) References Cited

U.S. PATENT DOCUMENTS

| | | | | |
|---|---|---|---|---|
| 7,252,143 | B2 | 8/2007 | Sellers et al. | |
| 7,281,578 | B2 | 10/2007 | Nakajima et al. | |
| 7,654,334 | B2 | 2/2010 | Manson | |
| 7,886,834 | B2 * | 2/2011 | Spencer | E21B 33/129 166/212 |
| 7,891,441 | B2 | 2/2011 | Lee | |
| 2003/0173076 | A1 * | 9/2003 | Sheiretov | B66F 3/12 166/241.1 |
| 2004/0011533 | A1 | 1/2004 | Lawrence et al. | |
| 2007/0034370 | A1 * | 2/2007 | Moyes | E21B 23/01 166/208 |
| 2008/0073086 | A1 * | 3/2008 | Cook | E21B 33/129 166/387 |
| 2009/0071659 | A1 * | 3/2009 | Spencer | E21B 23/01 166/382 |
| 2009/0223659 | A1 * | 9/2009 | Hill | E21B 23/01 166/55.1 |
| 2010/0089583 | A1 * | 4/2010 | Xu | E21B 10/322 166/298 |
| 2012/0298378 | A1 * | 11/2012 | McCauley | E21B 23/01 166/382 |
| 2017/0183927 | A1 * | 6/2017 | Herrera | E21B 33/1291 |

OTHER PUBLICATIONS

Anonymous, "Gauge Hanger," Standard Flow Control, Weatherford, 5688.01, 2005-2010, retrieved Dec. 18, 2013: pp. 1-2, <www.weatherford.com/weatherford/groups/web/documents/weatherfordcorp/www019181.pdf>.

Anonymous, "Gauge Hanger (GH)," Interwell, Rev: 2.0—121220, retrieved Dec. 18, 2013: pp. 1-2, <www.interwell.com/getfile.php/Dokumenter/Gh_Rev2.0_121220.pdf>.

Anonymous, "High Expansion Gauge Hanger," Omega Completion Technology Ltd., 2012: pp. 1-3, <http://www.versa-line.com/omega-tools/gauge-hanger>.

Anonymous, "High Expansion Retrievable Gauge Hanger," GeoKey, 2011: pp. 1-2.

* cited by examiner

HIGH RADIAL EXPANSION ANCHORING TOOL

CROSS-REFERENCE TO RELATED APPLICATIONS

None.

FIELD OF USE

Generally, methods and apparatus are presented for anchoring or positioning a gauge or other tool in a wellbore extending through a subterranean formation. More specifically, presented are anchoring devices for use on a wireline and having relatively high radial expansion, thereby allowing anchoring of a relatively small diameter gauge or other tool in standard tubing.

BACKGROUND

Mechanical operations are typically performed in the course of drilling, maintaining, and producing subterranean hydrocarbon wells, including operations requiring anchoring, temporarily or permanently, of one or more devices or tools in a downhole tubular such as tubing, liner, casing, etc. The anchoring may be required to allow the application of axial forces to the device, such as by fluid flow or tubing string manipulation. Anchoring may also be desirable to maintain a device in a selected position within the wellbore or to allow a device to be anchored in the wellbore without suspension or support from the surface, for example.

To facilitate anchoring, a downhole tool is anchored at a location in a wellbore with an anchoring device. For example, many anchoring devices use slips that support large forces. However, slips have limited radial expansion with respect to the tool body. Other anchoring devices use dogs or arms that extend from a tool body into a corresponding groove feature in a downhole tubular. Such devices support large forces but require special anchoring grooves at specific locations within the tubular.

Wireline tools are often employed and must be anchored within tubing at selected locations. Anchoring of the wireline tool can also require significant radial expansion of the anchoring mechanisms.

BRIEF DESCRIPTION OF THE DRAWINGS

For a more complete understanding of the features and advantages of the present disclosure, reference is now made to the detailed description of the disclosure along with the accompanying figures in which corresponding numerals in the different figures refer to corresponding parts and in which.

Figure 1:
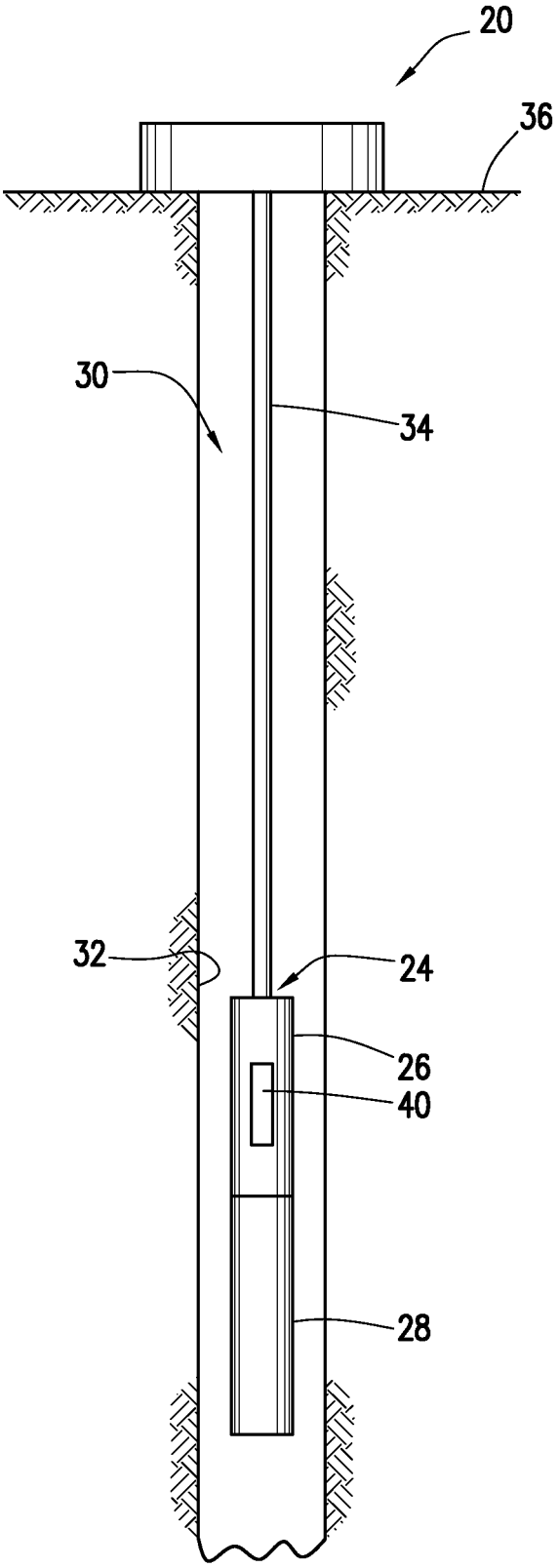
FIG. 1 is a schematic of an exemplary well system illustrated as having an anchoring tool positioned therein according to an aspect of the disclosure.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION

While the making and using of various embodiments of the present disclosure are discussed in detail below, a practitioner of the art will appreciate that the present disclosure provides applicable inventive concepts which can be embodied in a variety of specific contexts. The specific embodiments discussed herein are illustrative of specific ways to make and use the disclosure and do not limit the scope of the present disclosure. The description is often made with reference to a vertical wellbore. However, the disclosed embodiments herein can be used in horizontal, vertical, or deviated bores.

As used herein, the words "comprise," "have," "include," and all grammatical variations thereof are each intended to have an open, non-limiting meaning that does not exclude additional elements or steps. It should be understood that, as used herein, "first," "second," "third," etc., are arbitrarily assigned, merely differentiate between two or more items, and do not indicate sequence. Furthermore, the use of the term "first" does not require a "second," etc. The terms "uphole," "downhole," and the like, refer to movement or direction closer and farther, respectively, from the wellhead, irrespective of whether used in reference to a vertical, horizontal or deviated borehole.

The terms "upstream" and "downstream" refer to the relative position or direction in relation to fluid flow, again irrespective of the borehole orientation. Although the description may focus on a particular means for positioning tools in the wellbore, such as a tubing string, coiled tubing, or wireline, those of skill in the art will recognize where alternate means can be utilized. As used herein, "upward" and "downward" and the like are used to indicate relative position of parts, or relative direction or movement, typically in regard to the orientation of the Figures, and does not exclude similar relative position, direction or movement where the orientation in-use differs from the orientation in the Figures.

As used herein, "tubing," "downhole tubular," and the like refer to any downhole tubular member including tubing strings, work strings, series of connected pipe sections, joints, screens, blanks, cross-over tools, downhole tools, liners, casings, and the like, in or insertable into a wellbore, whether used for drilling, work-over, production, injection, completion, or other processes.

The present disclosure generally relates to apparatus and methods for anchoring a tool in a wellbore. The tool may be anchored within any downhole tubular, including casing, liner, internal tubing, etc., at a selected location, as well as in an open bore in some circumstances. The anchoring tool can be run-in on a wireline, slick line, coiled tubing, jointed tubing, and the like.

The anchoring tool can be used in conjunction with other downhole tools and systems. The anchoring tool is movable between a run-in and a set position and can be used with a running tool, setting tool, downhole power unit, or other type of actuator or power supply. The anchoring tool can be used to position or hang sensors and gauges in the wellbore, such as downhole gauge tools, as are known in the industry. Alternately, the tool can be used to provide an anchoring force to allow axial force to be applied to and operate additional downhole tools. The anchoring tool can be set to remain in position for extended periods of time, such as in a monitoring or abandoned well. The anchoring tool can also be sequentially set at various positions within the wellbore during wellbore operations.

The anchoring tool is designed to provide relatively significant radial expansion when moved to the set position from the run-in position. The significant radial expansion allows the tool to pass through restrictions in, for example, a tubing string or liner while in the run-in position. Upon setting, in the radially expanded and set position, the tool can be anchored in relatively larger diameter tubulars below such restrictions. The tool also enables anchoring in featureless tubing or monobore of a variety of diameters.

By way of example, and not by limitation, an exemplary embodiment of the disclosed tool can have a 1.5 inch outer diameter (OD) in the run-in position and expand to anchor in 2⅞ inch or 3½ inch OD tubing. For example, the tool can be run in 3½ inch, 10.2 lb/ft tubing, having an inner diameter (ID) of 2.98 inches. In such an instance, utilizing an anchoring tool having a 1.5 inch OD, the expansion ratio is approximately almost 1.99:1. In this example, the annular clearance between tool and tubular is 0.74 inches. By minimizing the OD of the anchoring tool, the flow restriction past the tool is also minimized.

In general, the anchoring tool functions by radially extending anchoring arms away from a tool housing until the arms contact and grippingly engage the wall of a downhole tubular. Each arm applies a radial force to the tubular surface which anchors the tool in place. As described herein below, each arm is extended radially outward through cooperation with and relative movement with respect to a wedge. The wedges support the arms while engaged with the tubular surface when the tool is in a set position. Each arm is deployed by relative movement in a first direction between the arm and its corresponding cooperating wedge. The arms are returned to a radially reduced, run-in position by relative movement in another (e.g., opposite) direction.

Referring generally to FIG. 1, one embodiment of a well system 20 is illustrated as having an anchoring assembly 24 including an anchoring tool 26. In this embodiment, the anchoring tool 26 is connected to a well tool 28 which may have a variety of forms depending on the specific well application in which the tools are utilized. For example, well tool 28 may comprise a wireline tool for performing a variety of downhole operations. Well tool 28 also may comprise a completion tool, a tool string, a treatment tool, or a variety of other tools deployed downhole, as is known in the art.

In the embodiment illustrated, anchoring tool 26 and well tool 28 are deployed downhole in a wellbore 30 within a tubular 32, which may comprise a well completion assembly, casing, production tubing, or other downhole structure. A conveyance 34, such as a wireline, is used to deploy the anchoring tool 26 and the well tool 28 into the wellbore 30 from the surface 36. Other conveyances, such as coiled tubing or jointed pipe, also can be used to deploy the anchoring tool.

Figure 2:
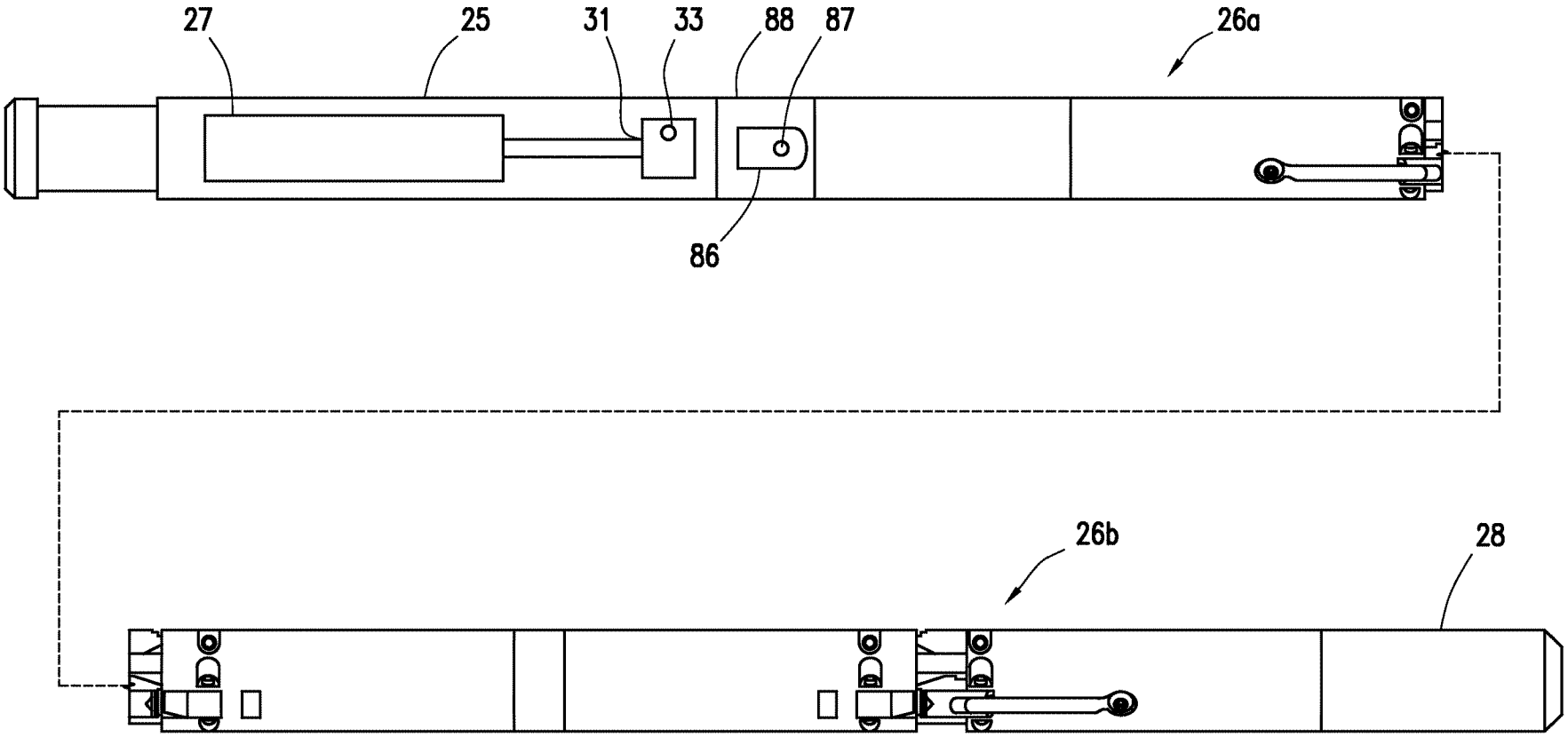
FIG. 2 is an elevational view of multiple exemplary anchoring tools connected in an exemplary tool string.

FIG. 2 is an elevational view of a plurality of exemplary anchoring tools 26*a-b* connected to a running or setting tool 25, optional locking sub 88, and a representative well tool 28 in an exemplary tool string. As shown, multiple anchoring tools 26*a-b* can be employed on a single tool string and used to insure successful anchoring of the string.

The setting tool 25 includes an actuator 27 which can be of any type and is operable to cause relative axial movement between the anchoring tool arms and wedges, thereby radially expanding the arms into contact with the downhole tubular 32. The actuator 27 of the setting tool 25 can be hydraulically, electrically, mechanically, electro-mechanically, chemically or otherwise powered. The setting tool 25 can provide linear or other force or movement. Further, the setting tool 25 can utilize one or more piston assemblies, linear actuators, such as a power screw or other type of screw-based actuator, etc. The actuator can comprise an explosive charge, a spring, a gas charge, or a combination thereof. In other embodiments the actuator 27 can comprise a slip joint disposed in the tool 26 enabling selective relative movement of the arms and wedges. By way of example, the actuator 26 can comprise a Baker Style 10 or 20 setting tool, commercially available from Baker-Hughes Oil Tools, Inc. Other setting tools are commercially available from Halliburton Energy Services, Inc., and Schlumberger Limited, for example.

In a preferred embodiment, a setting tool locking mechanism 31 is provided to maintain the actuator 27 in its set or stroked position after the operation or stroke of the actuator 27. The locking mechanism 31 for locking movement of the actuator can be positioned in the setting tool 26, a designated sub, or elsewhere. The locking mechanism 31 is preferably designed to lock the setting tool elements in the set position only after the set position has been reached. The locking mechanism 31 can be keyed to the actuator stroke length, radial movement of the anchor arms 40, resistance force acting on the actuator 27, etc. In a preferred embodiment, a shearing device 33, such as a shear pin, is provided in the setting tool 25 and is sheared upon completion of an effective actuator stroke. The shear pin releases a locking element which prevents movement of the actuator 27, relative movement of elements of the setting tool 25 and/or of the anchoring tool 26. The locking mechanism 31 prevents accidental or premature un-setting. The locking mechanism 31 can be a collet assembly, mating profiles, ratchet assembly, snap or lock ring, or other mechanism known in the art.

The optional locking sub 88 houses a selectively actuable and releasable locking mechanism 86. For example, the locking mechanism 86 can be a ratchet assembly having a release mechanism 87 such as a shear pin. The locking mechanism 86 maintains the tool 26 in a set position and, upon completion of desired operations, provides for releasing the tool 26 to an un-set or run-in position for subsequent retrieval.

Figure 3:
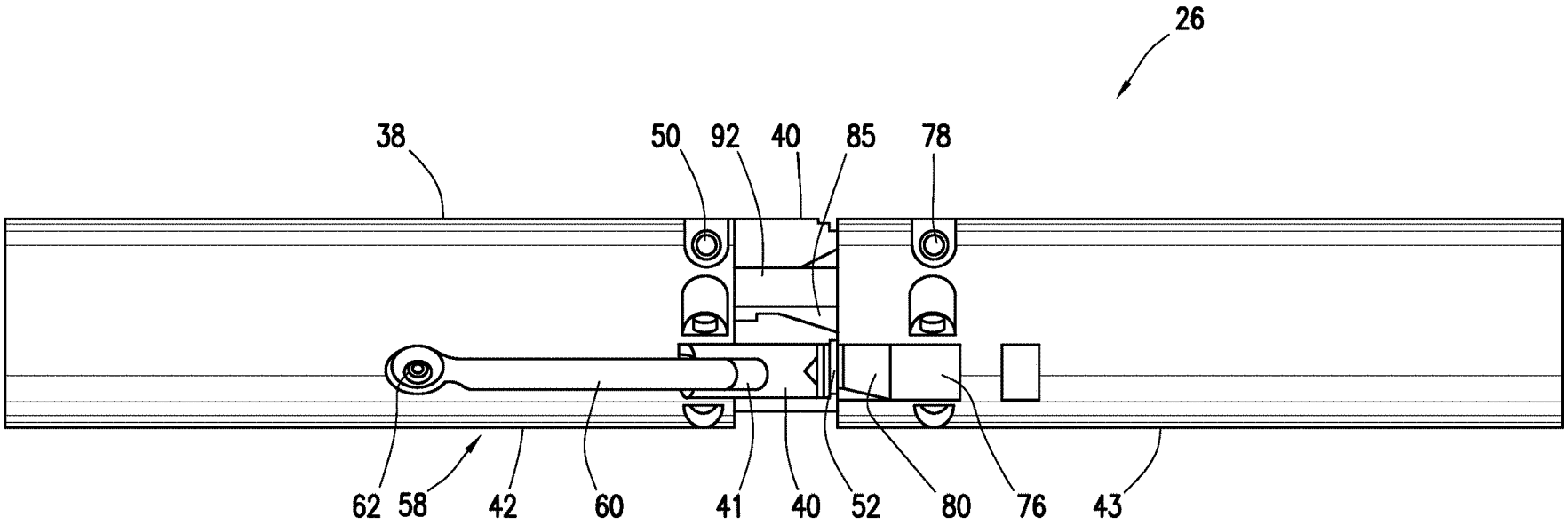
FIG. 3 is a detail, elevational view of a portion of an exemplary anchoring tool, seen in a run-in position, according to an aspect of the disclosure.
Figure 4:
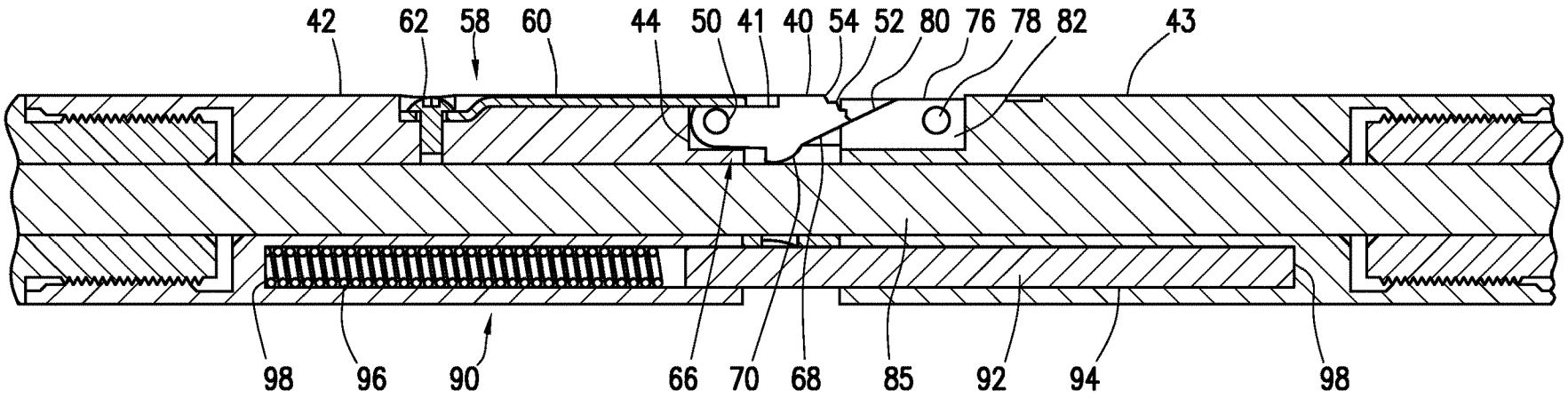
FIG. 4 is a cross-sectional view of an exemplary anchoring tool seen in a run-in or radially reduced position according to an aspect of the disclosure.
Figure 5:
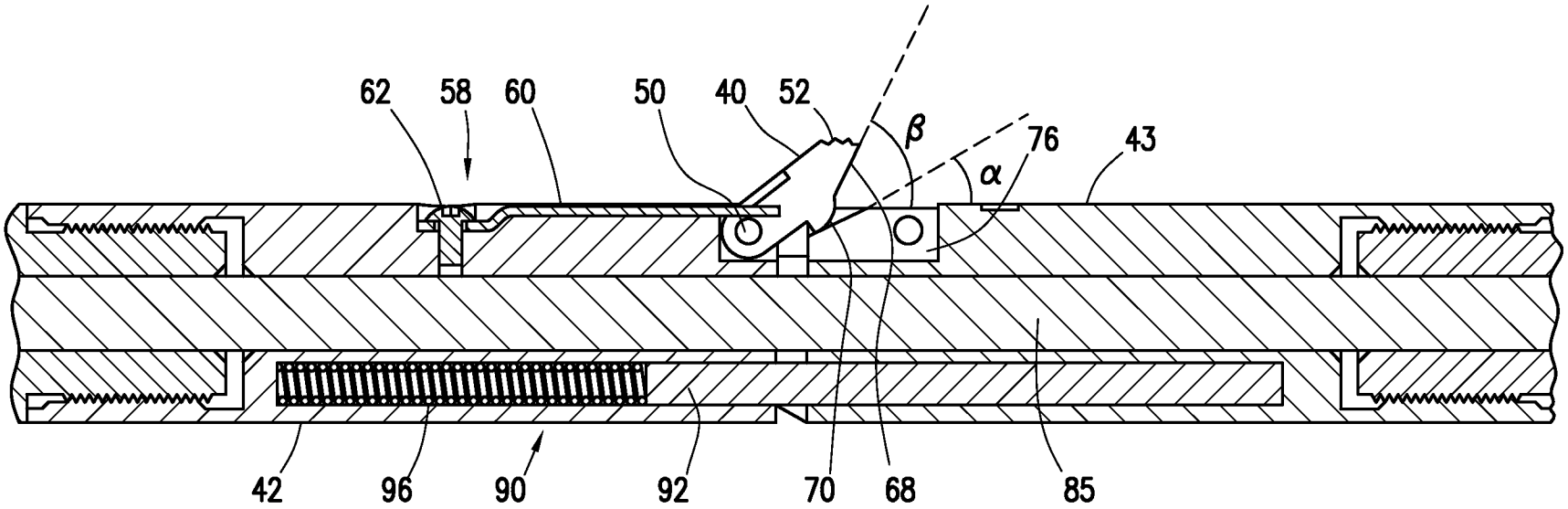
FIG. 5 is a cross-sectional view of an exemplary anchoring tool seen in a set or radially expanded position according to an aspect of the disclosure. These figures are discussed in conjunction, with like parts having like numbers throughout.

FIG. 3 is a detail, elevational view of a portion of an exemplary anchoring tool, seen in a run-in position, according to an aspect of the disclosure. FIG. 4 is a cross-sectional view of an exemplary anchoring tool seen in a run-in or radially reduced position according to an aspect of the disclosure. FIG. 5 is a cross-sectional view of an exemplary anchoring tool seen in a set or radially expanded position according to an aspect of the disclosure. These figures are discussed in conjunction, with like parts having like numbers throughout.

The anchoring tool 26 comprises a tool housing 38 and anchor arms 40 that move relative to the housing 38 between a radially contracted run-in position and a radially expanded set position. In FIG. 3, a portion of one embodiment of anchoring tool 26 is illustrated as having a plurality of arms 40 positioned in the run-in position to allow movement of the anchoring tool 26 through a downhole tubular 32, including through any restrictions therein. In the example shown, housing 38 comprises an upper body 42 and a lower body 43 which are connected and axially movable relative to one another.

The upper body 42 has recesses 44 sized to receive corresponding arms 40. When the arms 40 are in a radially contracted position, they can be contained within the envelope of the tool 26 such that the arms 40 do not limit the ability of tool 26 to pass through restrictions during deployment or retrieval of the tool 26. By way of example, the tool housing 38, and upper and lower bodies 42 and 43, may have a maximum OD of 1.5 inches when in the run-in position, with the arms positioned interior to the OD.

The arms 40 pivot between the run-in position seen in FIG. 4 and the radially expanded or "set" position seen in FIG. 5. Each arm 40 has a pivot hole extending therethrough which receives a pivot pin 50. The ends of the pivot pin 50 also engage mating holes in the upper body 42, thereby pivotally attaching the arm 40 to the upper body 42. The arm 40 defines a gripping or engagement surface 52 at its free end 54. In one or more embodiments the engagement surface 52 includes one or more gripping features, such as teeth, ridges, grooves, buttons, or other surface features to assist in grippingly engaging the downhole tubular 32.

In one or more embodiments, the arms 40 are held or urged toward the run-in position. For example, in a preferred embodiment, each arm 40 is biased toward the run-in position by a biasing assembly 58, such as leaf spring 60. The leaf spring 60 is attached, such as via screw or bolt 62, to the upper body 42. The free end of the leaf spring 60 engages the arm 40, exerting a biasing force on the arm, urging it toward the run-in position. During operation, as the arm 40 rotates to a set position, the free end of the leaf spring 60 is forced to bend away from the upper body 42. In the embodiment shown, the arm 40 defines a recess 41 sized to accept and interact with the biasing leaf spring 60. Upon release or disengagement of the anchoring tool 26, the arms 40 disengage from the wall of the tubular 32 and pivot back toward the run-in position, at least partially in response to the urging of the biasing spring 60. Other biasing mechanisms can be used, including springs, coil springs, torsion springs, elastomeric materials, etc. In one or more embodiments, the biasing mechanism resides within the tool envelope, as shown. Here, the leaf spring 60 and screw 62 are housed within recesses defined in the exterior of the upper body 42. The biasing mechanism can also be positioned radially interior to the arm 40 if desired.

In one or more embodiments, an additional or alternative biasing assembly 90 is provided having a shaft 92 positioned in corresponding bores 94 defined in the upper and lower bodies 42 and 43. A biasing element 96, such as the spring shown or similar, is positioned to exert force on the shaft 92. The bores 94 define contact shoulders 98 for limiting movement of the shaft 92 and biasing element 96. When the upper and lower bodies 42 and 43 are in the set position, seen in FIG. 5, the biasing element 96 exerts force on the shaft 92, which in turn exerts force on the lower shoulder 98, urging the upper and lower bodies 42 and 43 axially apart from one another and toward the run-in position. The shafts 92, of which there are three in the embodiment seen, also serve to prevent relative rotation of the upper and lower bodies 42 and 43, providing torsional rigidity to the tool 26.

Arm 40 defines a radially inward facing surface 66, referred to herein as the interior surface 66. The interior surface 66 extends along the arm 40 from adjacent the pivot pin 50 to the engagement surface 52 at the free end 54 of the arm 40. The interior surface 66, in a preferred embodiment, defines at least an initial contact surface 68 and a cam surface 70 which interact with corresponding wedge 76 during setting of the tool 26.

The lower body 43 includes wedges 76 which correspond to and cooperate with the arms 40. The wedges 76 can be formed by the lower body 43 or can be mounted to the body, such as by bolts 78. In this way, the wedges 76 can easily be removed and replaced. In one or more embodiments, the wedges 76 are fitted into corresponding recesses 82 defined in the exterior surface of the lower body 43. Each wedge 76 defines a sloped contact surface 80 which contacts and forces pivotal movement of the corresponding arm 40 during setting. The wedge surface 80 also supports the arm 40 while in the set position. In one or more embodiments, the wedge surface 80 is generally planar. The wedge 76 and its contact surface 80 are preferably made of an extremely hard material to minimize flexion. Also preferably, the wedge 76 or its contact surface 80 is made of a self-lubricating material.

In use, the tool 26 is attached to a conveyance 34, such as a wireline, slick line, coiled tubing, tubing string, etc., and lowered into the wellbore 30 and the tubular 32 positioned therein. The tool 26 is initially in a run-in position wherein the anchor arms 40 are retracted to a radially reduced profile. One or more biasing mechanisms operate to maintain the arms 40 in the run-in position. For example, as discussed previously, the leaf spring 60 of biasing assembly 58 can be employed to inhibit movement of the arm 40. Alternately or additionally, the biasing assembly 90 can urge the upper and lower bodies 42 and 43 toward the run-in position.

The tool, having a relatively small OD, is sized to pass through restrictions which may be present in the tubular 32, for example. The tool 26 is positioned in the wellbore 30 at a desired location. The tool 26 is then set into a set position wherein the arms 40 are in gripping engagement with the tubular 32. Wellbore operations are then run, as desired. For example, the tool 26 can support a well tool 28, such as a gauge tool, in the wellbore 30 to take short-term or long-term measurements. Alternately, the tool 26 can support other well tools. The conveyance 34 can be detached from the tool 26 if desired and removed to the surface. In such a case, a conveyance 34 is later lowered into the wellbore 30 to un-set and retrieve the tool 26. Upon completion of operations, the tool 26 is retracted from its set position to its run-in position for movement to another location, such as the surface 36 or another downhole position.

Actuation of the anchoring tool 26 from the run-in to the radially expanded, set position is caused by moving the upper body 42 and the lower body 43 axially with respect to one another. FIGS. 4 and 5 show the upper and lower bodies in their relative positions during run-in (FIG. 4) and after setting the tool (FIG. 5). As the upper and lower bodies are moved axially toward one another, so are the wedges 76 and the corresponding arms 40. The initial contact surface 68 of the interior surface 66 of the arm 40 contacts and slides along the sloped contact surface 80 of the wedge 76 during initial movement of the arm 40 from the run-in to the set position. The initial contact surface 68 of the arm 40 is preferably generally planar, as shown. In response to contact with the contact surface 80 of the wedge 76, arm 40 pivots outwardly at a first pivot rate and to a first maximum angle $\alpha$ (with respect to the longitudinal axis of the tool) and to a first maximum OD. The cam surface 70 defined on the interior surface 66 of the arm 40 subsequently contacts and slides along the contact surface 80 of the wedge 76, resulting in a second, increased pivot rate for the arm 40 during setting, and a second greater maximum pivot angle $\beta$ and second or maximum OD when the arm 40 is fully radially extended. Thus, the cam surface allows for a relatively greater radial expansion of the pivoting arm 40, allowing the tool 26 to have a relatively greater expanded OD to run-in OD ratio. The cam surface 70 maintains contact with the wedge 76 while the arm 40 is in the set position such that the wedge 76 supports the arm 40. In the example illustrated, the tool 26 comprises three arms 40, however other numbers of anchoring arms can be used in alternate embodiments. The arm 40 pivots radially outward into gripping engagement with the wall of the tubular 32. The tool 26 is then in the set position and supports itself in the wellbore 30.

Relative axial movement of each of the wedges 76 away from the arms 40 causes the arms 40 to pivot back toward the radially reduced, run-in position. In one or more embodiments, a biasing assembly 58 having leaf spring 60, biases the arms 40 towards the run-in position. Similarly, the biasing assembly 90 can force movement of the arms 40 toward the run-in position. As the upper and lower bodies 42 and 43 are moved axially apart, the arms 40 disengage the wall of the tubular 32 and return to their run-in positions.

Relative axial movement of the upper and lower bodies 42 and 43, and therefore the wedges 76 and arms 40, can be achieved by an actuator 27 Actuator 27 is coupled to the upper body 42 and/or lower body 43 to induce the desired relative axial movement. In the embodiment illustrated in FIG. 2, a setting tool 25 is connected to the tools 26*a-b* to operate the anchor assemblies. For example, the setting tool 25 can pull upward on one or more interior body elements, such as a core rod 85, while pushing down on exterior body elements, such as upper and lower bodies 42 and 43, or vice versa. The core rod 85 extends the length of the tool 26 and is fixedly attached to the lower body 43. The core rod 85 is initially and releasably attached to the upper body 42 by a temporary holding mechanism, such as a shear pin, shear ring, etc. For example, shear pins selected to shear upon application of ten pounds of force can extend between the upper body 42 and the core rod 85.

In one or more embodiments, a releasable, locking mechanism 86 is provided allowing selective and temporary locking of relative movement between the upper body 42 and the core rod 85. When the core rod 85 is moved axially upward relative to the upper body 42 in response to actuation of the actuator 27, thereby setting the tool 26, the locking mechanism 86 actuates and prevents premature or accidental un-setting of the tool 26. The locking mechanism 86 can be a collet device, mating profiles, a ratchet assembly, a snap or lock ring, or other mechanism known in the art. In one or more embodiments, the locking mechanism 86 is housed in a sub 88 attached to the upper end of the tool 26. Alternately, the locking mechanism 86 can be housed in the anchoring tool 26 or setting tool 25. Releasing the locking mechanism 86 can be achieved by various means, such as by forcing the core rod 85 downward or upward, removing a collet support, shearing, snapping, or forcing a temporary holding device such as a shear pin or ring, mating profiles, sliding sleeve, ratchet, etc. Releasing the locking mechanism 86 can be achieved by mechanical methods, such as manipulation of the conveyance 34 from the surface 36, actuation of a downhole power unit, etc.

In one or more embodiments, the actuator 27 in the setting tool 25 pulls upward on the core rod 85, thereby shearing shear pins attaching the upper body 42 to the core rod 85. The lower body 43 is moved upward with the core rod 85. In this manner, the lower body 43 is moved axially into closer proximity to the upper body 42. Each wedge 76 positioned on the lower body 43 is moved relative to its corresponding arm 40, with wedge contact surface 80 acting upon the interior surface 66 of the arm 40, thereby forcing rotation of the arm 40 radially outward toward the set position.

The anchoring tools and methods presented herein provide a simple mechanical design utilizing pivoting arms which are not articulated, jointed, or part of a linkage assembly. The tool is consequently less likely to jam, plastically deform, or fail due to weaknesses typical to articulated assemblies.

The anchoring tools and methods presented herein can be used in a variety of well systems and in applications. The anchoring tool can be constructed with two anchoring arms, three anchoring arms, or a greater number of anchoring arms depending on the parameters of a given application. Additionally, the anchoring tool can be incorporated into or used in cooperation with other types of well tools. The anchoring tool can be deployed singly or with multiple anchoring tools in series. The anchoring tool can be deployed via wireline or other suitable conveyance. Furthermore, the one or more anchoring tools can be actuated via a variety of actuators, including hydraulic, electrical, electro-mechanical, explosive charge, gas charge, spring, conveyance manipulation, and other suitable actuators.

In one or more embodiments, the methods described here and elsewhere herein are disclosed and support method claims submitted or which may be submitted or amended at a later time. The acts listed and disclosed herein are not exclusive, not all required in all embodiments of the disclosure, can be combined in various ways and orders, repeated, omitted, etc., without departing from the spirit or the letter of the disclosure. For example, disclosed is an exemplary method of using an anchoring tool in a wellbore extending through a subterranean formation, the method comprising the steps of: 1. A method of positioning an anchoring tool in a downhole tubular positioned in a wellbore, the method comprising: running an anchoring tool into a downhole tubular, the anchoring tool in a run-in position, wherein pivot arms pivotally mounted on the tool are disposed in a radially inward position; positioning the anchoring tool at a selected location in the downhole tubular; and setting the anchoring tool in the tubular, comprising: moving an upper and lower body of the anchoring tool axially relative to one another; moving wedges positioned on the upper or lower body, axially relative to corresponding pivot arms positioned on the other of the upper or lower body; sliding a sloped contact surface defined on each wedge relative to a contact surface defined on each corresponding pivot arm; and pivoting the pivot arms, in response to the relative sliding movement of the wedge and arm contact surfaces, radially outward and into gripping engagement with the tubular. 2. The method of claim 1, further comprising releasing the anchoring tool from the set position by pivoting the pivot arms toward the run-in position. 3. The method of claim 1 or 2, wherein the contact surface defined on each pivot arm further comprises: an initial contact surface and a cam surface, and further comprising: sliding the initial contact surface along the wedge contact surface; and pivoting the pivot arm radially outward to a first angle with respect to a longitudinal axis of the anchoring tool. 4. The method of claim 3, further comprising: sliding the cam surface along the wedge contact surface after pivoting the arm to the first angle; and pivoting the pivot arm radially outward to a second angle with respect to a longitudinal axis of the anchoring tool, the second angle greater than the first angle. 5. The method of claims 3-4, wherein the first angle is the maximum angle achievable by relative sliding movement of the wedge contact surface along the initial contact surface of the pivot arm. 6. The method of claims 1-5, wherein the pivot arms have gripping surfaces for gripping the tubular, the gripping surfaces selected from the group consisting of: teeth, ridges, grooves, and buttons. 7. The method of claims 2-5, wherein releasing the anchoring tool from the set position further comprises moving the upper and lower bodies axially away from one another. 8. The method of claim 7, wherein releasing the anchoring tool from the set position further comprises biasing the upper and lower bodies axially away from one another. 9. The method of claim 8, wherein the biasing is performed by a spring, positioned in the upper or lower body, exerting force against a surface defined on the other of the upper or lower body. 10. The method of claim 9, wherein the spring exerts force against a shaft movable mounted in the upper and lower bodies. 11. The method of claims 1-10, further comprising biasing the pivot arms towards the run-in position. 12. The method of claim 11, wherein the biasing is performed by springs exerting force on corresponding pivot arms and urging the pivot arms radially inwardly. 13. The method of claims 1-12, further comprising, after moving the upper and lower body of the anchoring tool axially relative to one another, releasably locking the upper body and lower body relative to one another in a set position. 14. The method of claim 13, wherein the locking is performed by a locking mechanism selected from the group consisting of: a collet device, mating profiles, a ratchet mechanism, a snap ring, and a lock ring. 15. The method of claims 1-12, wherein moving the upper and lower body of the anchoring tool axially relative to one another further comprises moving a core rod positioned in the anchoring tool, the core rod attached to the lower body. 16. The method of claims 1-15, wherein the pivot arms are housed in recesses defined in the upper or lower body. 17. The method of claims 1-16, wherein the wedges are removable mounted in recesses defined in the upper or lower body. 18. The method of claims 1-17, wherein the contact surfaces of the wedges are self-lubricating. 19. The method of claims 1-18, wherein setting the anchoring tool in the tubular further comprises actuating a downhole actuator to cause relative movement of the upper and lower bodies. 20. The method of claims 1-19, wherein running the anchoring tool into the downhole tubular further comprises running-in the tool on a conveyance selected from the group consisting of: wireline, slick line, coiled tubing, or jointed tubing.

Exemplary methods of use of the disclosure are described, with the understanding that the disclosure is determined and limited only by the claims. Those of skill in the art will recognize additional steps, different order of steps, and that not all steps need be performed to practice the disclosed methods described.

Persons of skill in the art will recognize various combinations and orders of the above described steps and details of the methods presented herein. While this disclosure has been described with reference to illustrative embodiments, this description is not intended to be construed in a limiting sense. Various modifications and combinations of the illustrative embodiments as well as other embodiments of the disclosure will be apparent to persons skilled in the art upon reference to the description. It is, therefore, intended that the appended claims encompass any such modifications or embodiments.

It is claimed:

1. A method of positioning an anchoring tool in a downhole tubular positioned in a wellbore, the method comprising:

biasing pivot arms of an anchoring tool to a run-in position with biasing arms, each biasing arm positioned entirely on an exterior of the anchoring tool and coupled to an external surface of the anchoring tool, the biasing arm engaging an external surface of a respective pivot arm and exerting a biasing force on the pivot arm, wherein the pivot arms are pivotally mounted on the anchoring tool and are disposed in a radially inward position;

running an anchoring tool into a downhole tubular, the anchoring tool in the run-in position;

positioning the anchoring tool at a selected location in the downhole tubular; and setting the anchoring tool in the tubular, comprising:

moving an upper and lower body of the anchoring tool axially relative to one another;

moving wedges positioned on the lower body, axially relative to corresponding pivot arms positioned on the upper body, wherein each pivot arm defines an initial contact surface that transitions directly to a cam surface, the cam surface extending outward with respect to the initial contact surface, and each wedge defines a sloped contact surface;

sliding each initial contact surface with respect to the corresponding sloped contact surface to extend the pivot arms outward at a constant first angle with respect to a longitudinal axis of the anchoring tool; and continuing to slide each initial contact surface along the respective sloped contact surface such that each cam surface contacts the corresponding sloped contact surface to pivot the pivot arms radially outward from the constant first angle to a second angle with respect to the longitudinal axis of the anchoring tool and into a gripping engagement with the tubular, the second angle greater than the constant first angle.

2. The method of claim 1, further comprising releasing the anchoring tool from the set position by pivoting the pivot arms toward the run-in position.

3. The method of claim 2, wherein releasing the anchoring tool from the set position further comprises moving the upper and lower bodies axially away from one another.

4. The method of claim 3, wherein releasing the anchoring tool from the set position further comprises biasing the upper and lower bodies axially away from one another.

5. The method of claim 4, wherein the biasing is performed by a spring, positioned in the upper or lower body, exerting force against a surface defined on the other of the upper or lower body.

6. The method of claim 5, wherein the spring exerts force against a shaft movably mounted in the upper and lower bodies.

7. The method of claim 1, wherein the pivot arms have gripping surfaces for gripping the tubular, the gripping surfaces selected from the group consisting of: teeth, ridges, grooves, and buttons.

8. The method of claim 1, wherein each biasing arm is a spring.

9. The method of claim 1, further comprising, after moving the upper and lower body of the anchoring tool axially relative to one another, releasably locking the upper body and lower body relative to one another in a set position.

10. The method of claim 9, wherein the locking is performed by a locking mechanism selected from the group consisting of: a collet device, mating profiles, a ratchet mechanism, a snap ring, and a lock ring.

11. The method of claim 1, wherein moving the upper and lower body of the anchoring tool axially relative to one another further comprises moving a core rod positioned in the anchoring tool, the core rod attached to the lower body.

12. The method of claim 1, wherein the pivot arms are housed in recesses defined in the upper or lower body.

13. The method of claim 1, wherein the wedges are removably mounted in recesses defined in the upper or lower body.

14. The method of claim 1, wherein the contact surfaces of the wedges comprise a self-lubricating material.

15. The method of claim 1, wherein setting the anchoring tool in the tubular further comprises actuating a downhole actuator to cause relative movement of the upper and lower bodies.

16. The method of claim 1, wherein running the anchoring tool into the downhole tubular further comprises running-in the tool on a conveyance selected from the group consisting of: wireline, slick line, coiled tubing, or jointed tubing.

17. An anchoring tool for anchoring within a downhole tubular positioned in a wellbore, the tool comprising:

a tool housing having upper and lower bodies mounted for relative axial movement in relation to one another;

a plurality of anchoring arms pivotally mounted to the upper body, the anchoring arms pivoting between a radially inward position and a radially expanded position, each anchoring arm defining an initial contact surface that directly transitions to a cam surface, the cam surface extending outward with respect to the initial contact surface;

a plurality of biasing arms, each biasing arm positioned entirely on an exterior of the anchoring tool and coupled to an external surface of the anchoring tool, the biasing arm engaging an external surface of a respective pivot arm and exerting a biasing force on the pivot arm to bias the pivot arm to a run-in position; and a plurality of wedges mounted to the lower body, each wedge corresponding to an anchoring arm and defining a contact surface for moving the corresponding anchoring arm from the radially inward position toward the radially expanded position, wherein:

the initial contact surface is positioned to cooperate with a corresponding wedge to extend the anchoring arm radially outward at a constant first angle with respect to a longitudinal axis of the anchoring tool, and the cam surface is positioned to cooperate with a corresponding wedge to pivot the anchoring arm radially outward from the constant first angle to a second angle with respect to the longitudinal axis of the anchoring tool, the second angle greater than the constant first angle.

18. The anchoring tool of claim 17 further comprising a core rod positioned within the tool housing and fixedly attached during use to one of the upper or lower body.

19. The anchoring tool of claim 18, further comprising a selectively actuable and releasable locking mechanism interconnected between the core rod and one of the upper or lower bodies.

20. The anchoring tool of claim 19, wherein the locking mechanism is selected from the group consisting of: a collet device, mating profiles, a ratchet mechanism, a snap ring, and a lock ring.

21. The anchoring tool of claim 17, wherein the wedge contact surface comprises a self-lubricating material.

22. A system for anchoring in a tubular positioned downhole in a wellbore, the system comprising:

an anchoring tool having:

a housing with upper and lower bodies mounted for relative axial movement in relation to one another;

a plurality of anchoring arms pivotally mounted to the upper body, the anchoring arms pivoting between a radially inward position and a radially expanded position, each anchoring arm defining an initial contact surface that directly transitions to a cam surface, the cam surface extending outward with respect to the initial contact surface;

a plurality of biasing arms, each biasing arm positioned entirely on an exterior of the anchoring tool and coupled to an external surface of the anchoring tool, the biasing arm engaging an external surface of a respective pivot arm and exerting a biasing force on the pivot arm to bias the pivot arm to a run-in position;

a plurality of wedges mounted to the lower body, each wedge corresponding to an anchoring arm and positioned to move the corresponding anchoring arm from the radially inward position toward the radially expanded position, wherein:

the initial contact surface is positioned to cooperate with a corresponding wedge to extend the anchoring arm radially outward at a constant first angle with respect to a longitudinal axis of the anchoring tool, and the cam surface is positioned to cooperate with a corresponding wedge to pivot the anchoring arm radially outward from the constant first angle to a second angle with respect to the longitudinal axis of the anchoring tool, the second angle greater than the constant first angle; and an actuator operably connected to the anchoring tool to cause relative axial movement between the upper and lower bodies.

23. The system of claim 22, wherein the anchoring tool further comprises a core rod positioned within the tool housing and fixedly attached during use to one of the upper or lower body.

24. The system of claim 23, further comprising a selectively actuable and releasable locking mechanism interconnected between the core rod and one of the upper or lower body.

25. The system of claim 24, wherein the locking mechanism is selected from the group consisting of: a collet device, mating profiles, a ratchet mechanism, a snap ring, and a lock ring.

26. The system of claim 22, wherein the actuator is connected to the core rod to cause axial movement of the core rod.

27. The system of claim 26, wherein the actuator is hydraulically, electrically, mechanically, electro-mechanically, or chemically powered.

* * * * *